US006640708B2

(12) United States Patent
Perez et al.

(10) Patent No.: US 6,640,708 B2
(45) Date of Patent: Nov. 4, 2003

(54) PULSATING VACUUM MECHANISM FOR PRINT MEDIA-ADVANCEMENT IN A PRINTING DEVICE

(75) Inventors: Francisco Javier Perez, Barcelona (ES); David Claramunt, Barcelona (ES); Jesus Garcia, Barcelona (ES); Xavier Gros, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/984,537

(22) Filed: Oct. 30, 2001

(65) Prior Publication Data

US 2003/0079630 A1 May 1, 2003

(51) Int. Cl.[7] ..... B41F 13/24; B41J 15/00; B41J 11/02; B65H 3/14

(52) U.S. Cl. ..... 101/232; 400/578; 400/582; 400/648; 400/656; 271/98

(58) Field of Search ..... 400/648, 656, 400/582, 578; 271/98, 11, 18.1; 101/126, 232, 420, 319, 407.1, 474; 347/88, 104, 43

(56) References Cited

U.S. PATENT DOCUMENTS 4,635,548 A * 1/1987 Pensky et al. ..... 101/319
2002/0062750 A1 * 5/2002 Wotton et al. ..... 101/232

* cited by examiner

*Primary Examiner*—Andrew H. Hirshfeld
*Assistant Examiner*—Hoai-An D. Nguyen
(74) *Attorney, Agent, or Firm*—Lee & Hayes, PLLC

(57) ABSTRACT

A printing device includes a print media advancement subsystem for providing accurate and timely print media advancement in the printing device. The print media advancement subsystem includes a vacuum chamber for generating a vacuum force through a platen for holding a print media stationary. In response to receiving a print media advance signal from a controller in the printing device, a sealing plate forming a side of the vacuum chamber is removed from the vacuum chamber. When the sealing plate is removed, the vacuum chamber is substantially open to the atmosphere, causing the vacuum chamber to pressurize. The pressurization of the vacuum chamber results in removal of the vacuum force from the print media, allowing the print media to advance along the top surface of the platen with minimal friction.

21 Claims, 5 Drawing Sheets

PULSATING VACUUM MECHANISM FOR PRINT MEDIA-ADVANCEMENT IN A PRINTING DEVICE

FIELD OF THE INVENTION

The invention is generally related to printing devices. More particularly, the invention is related to a vacuum control mechanism for improving print media advancement in a printing device.

BACKGROUND OF THE INVENTION

It is known to use a vacuum induced force to adhere a sheet of print media to a surface in a printing device. For example, a vacuum may be used for holding a sheet of print media temporarily to a platen (e.g., a print media hold-down surface used in a printing device). In a printing device implementation, typically the platen is used either to transport cut-sheet print media to a printing station of a printing device (e.g., printer, photocopier, facsimile, and the like) and/or to hold the print media at the printing station while images are formed at the printing area (e.g., the print zone) of the printing device. Such vacuum hold-down systems are a relatively common, economical technology to implement commercially and can improve throughput specifications.

One universal problem, particularly pertinent in the adaptation of a vacuum hold-down system used in a printing device, is related to print media advancement. When print media advances through a print zone, friction is created between the print media and the platen. The resulting friction can decrease line feed accuracy, which can result in the misalignment of the print media through the print zone and inferior print quality.

A conventional technique for minimizing friction on the platen includes switching a vacuum fan, which generates the vacuum force in a vacuum chamber for holding the print media against the platen, on and off. By switching the vacuum fan off when print media is advancing through a print zone, friction between the print media and the platen is reduced. However, the period of time to pressurize/depressurize a vacuum chamber can have a magnitude in the tens of seconds, which drastically increases printing times. For example, the vacuum fan can typically operate at approximately 9000 rpm to generate the vacuum force. When the fan is switched off, it may continue to spin at a high rpm for a period of time. This increases the time to pressurize the vacuum chamber, and increases print times. Therefore, the throughput of the printing device may be drastically reduced. The period of time to depressurize the chamber when the vacuum fan is switched on may also result in a drastic reduction of throughput for the printing device.

Another conventional technique utilizes two accumulation vacuum chambers having two different vacuum levels (e.g., one chamber having the pressure of the atmosphere and one having a higher pressure for providing more vacuum force to hold down the print media). A switch connects a main vacuum chamber underneath the platen to one of the two accumulation chambers, depending on whether the print media needs to advance or be secured in the print zone. However, the main chamber underneath the platen still needs to pressurize/depressurize depending on which of the two accumulation chambers are connected to the main chamber through the switch. The period of time to pressurize/depressurize the main chamber is dependent on the size of the accumulation chamber connected to the main chamber. Typically, an accumulation chamber is at least twice as large as the main chamber. The use of accumulation chambers may increase the size of the printing device and the cost of the printing device.

SUMMARY OF THE INVENTION

In an embodiment of the invention, a method is provided for controlling print media advancement in a printing device. The method comprises steps of substantially sealing a vacuum chamber; depressurizing the vacuum chamber to generate a vacuum force for holding a print media; substantially opening the vacuum chamber to pressurize the vacuum chamber; and advancing the print media.

In another embodiment of the invention a printing device is provided that comprises a vacuum control mechanism for controlling a vacuum force applied to a print media. The vacuum control mechanism is configured to substantially open and close a vacuum chamber to control the vacuum force applied to the print media.

In still another embodiment of the invention, a print media advancement subsystem in a printing device is provided. The print media advancement subsystem comprises a vacuum chamber including a U-shaped vacuum guide, a platen covering the U-shaped vacuum guide and forming the top of the vacuum chamber, and a sealing plate forming a side of the vacuum chamber. The sealing plate is removable to substantially open and substantially seal the vacuum chamber. A vacuum force is applied through the platen to a print media supported by a top surface of the platen when the vacuum chamber is substantially sealed, and the vacuum force is substantially removed from the print media when the vacuum chamber is substantially open. The print media advancement subsystem further comprises a control mechanism connected to the sealing plate and configured to remove the sealing plate from the vacuum chamber in response to receiving a print media advance signal from a controller in the printing device.

In comparison to known prior art, certain embodiments of the invention are capable of achieving certain aspects. For example, certain embodiments provide a print media advancement system that can reduce the cost and size of conventional systems and provide accurate paper advancement that minimizes paper misalignment during printing and increases print quality. Also, certain embodiments provide a robust mechanism that can increase the life of the printing device. Those skilled in the art will appreciate these and other advantages and benefits of various embodiments of the invention upon reading the following detailed description of a preferred embodiment with reference to the below-listed drawings.

BRIEF DESCRIPTION OF THE DRAWINGS

The present invention is illustrated by way of example and not limitation in the accompanying figures in which like numeral references refer to like elements, and wherein.

DETAILED DESCRIPTION OF THE INVENTION

In the following detailed description, numerous specific details are set forth in order to provide a thorough understanding of the present invention. However, it will be apparent to one of ordinary skill in the art that these specific details need not be used to practice the present invention. In other instances, well known structures, interfaces, and processes have not been shown in detail in order not to unnecessarily obscure the present invention.

Figure 1:
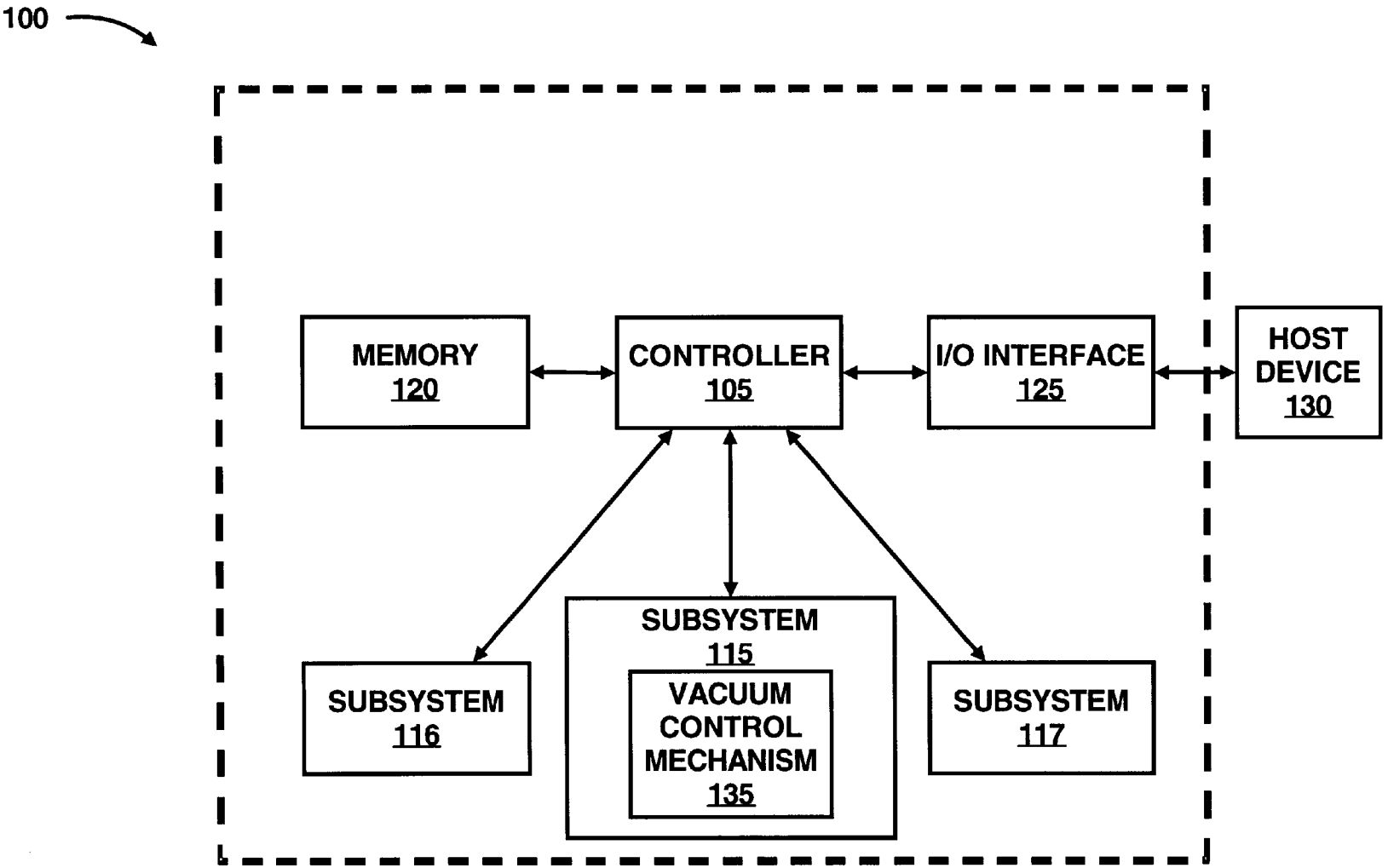
FIG. 1 illustrates an exemplary system employing principles of the invention.

FIG. 1 illustrates an exemplary printing device system 100. The system 100 includes a controller 105 connected to multiple subsystems 115–117. The controller 105 is also connected to a memory 120 and a host device 130.

The controller 105 may be configured to provide control logic for the system 100 (e.g., the functionality for a printer). In this respect, the controller 105 may possess a microprocessor, a micro-controller, an application specific integrated circuit, and the like. The controller 105 may be interfaced with the memory 120 that is configured to provide storage of a computer software that provides the functionality for the system 100. The memory 120 may also be configured to store maintenance information for each subsystem. The memory 120 may be implemented as a combination of volatile and non-volatile memory, such as dynamic random access memory ("RAM"), EEPROM, flash memory, and the like.

The system 100 may be connected to the host device 130 (e.g., personal computer, server, personal digital assistant, and the like) through an I/O interface 125. The I/O interface 125 is configured to provide a communication channel between the host device 130 and the controller 105. The I/O interface 125 may conform to protocols, such as RS-232, parallel, small computer system interface, universal serial bus, etc. The system 100 may include a standalone device, however, that is not connected to a host device.

The controller 105 is connected to the subsystem 115, which is a print media advancement subsystem 115. The print media advancement subsystem 115 includes a vacuum control mechanism (VCM) 135. The VCM 135 receives print media advancement control signals from the controller 105 for controlling the amount of vacuum force applied to a print media (e.g., paper or other conventional print media). For example, the VCM 135 receives a print media advance signal from the controller 105. Then, the VCM 135 removes the vacuum force applied to the print media to allow the print media to advance freely to the next subsystem in the system 100. Then, the VCM 135 applies sufficient vacuum force to the print media to prevent movement of the media, for example, in the print zone during printing.

Subsystems 116 and 117 include conventional subsystems in a printing device (e.g., ink drop subsystem, print media output subsystem, and the like). The system 100 includes three subsystems 115–117 for illustration purposes, and it will be apparent to one of ordinary skill in the art that the system 100 may include as many subsystems as necessary to facilitate printing.

Figure 2A:
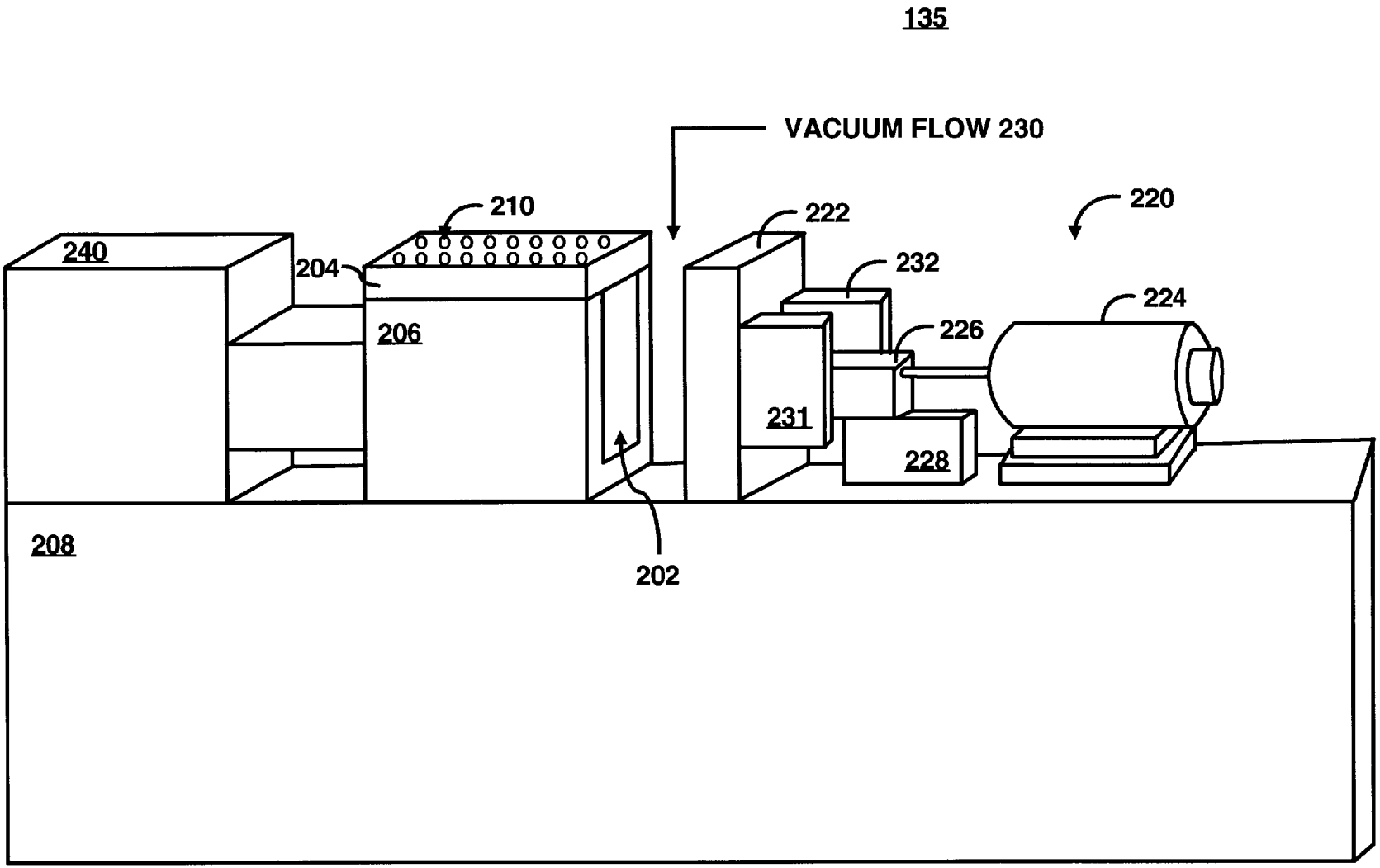
FIGS. 2A–B illustrate an exemplary vacuum control mechanism employing principles of the invention.
Figure 2B:
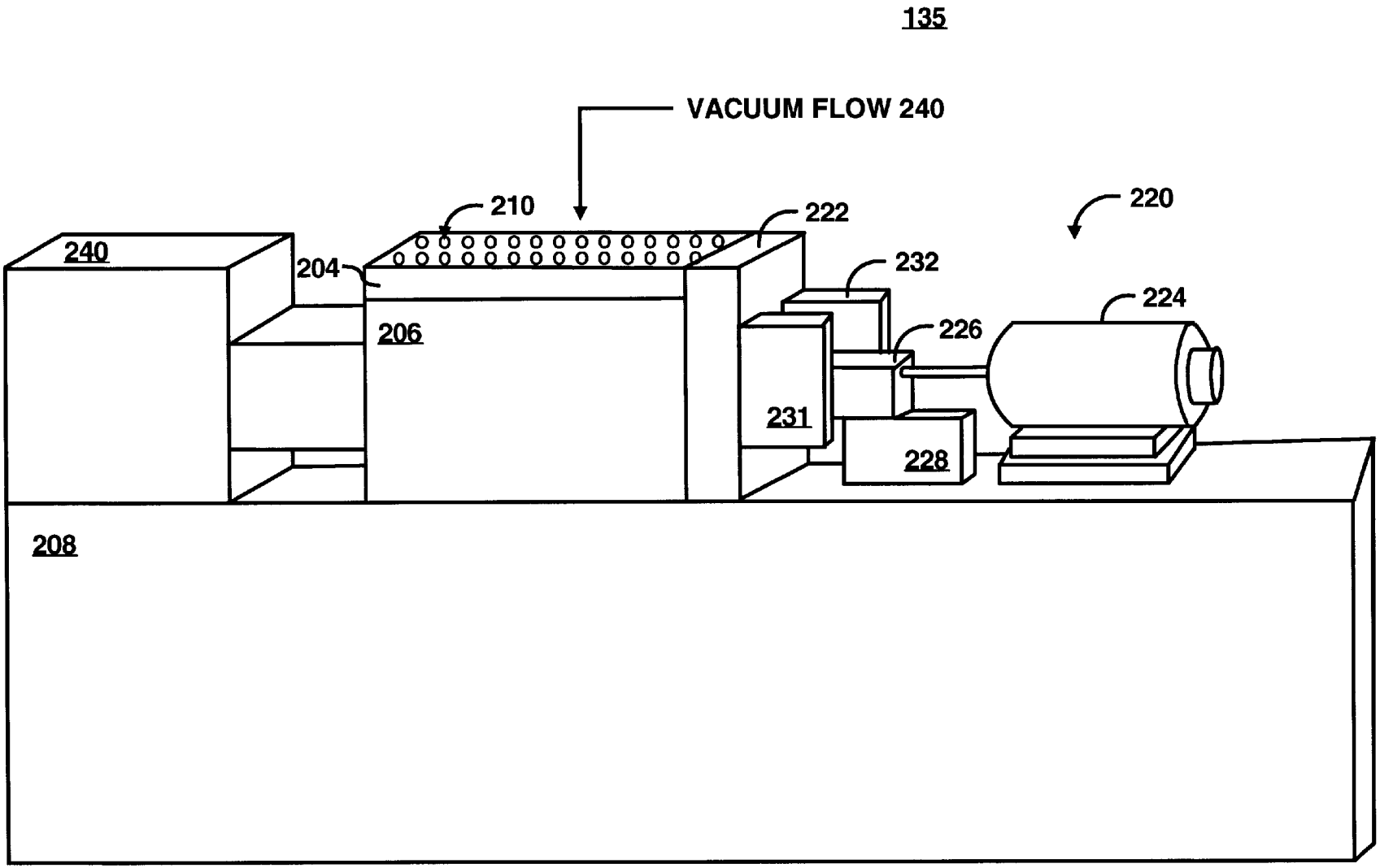

FIGS. 2A–B illustrate the VCM 135 in two different positions to facilitate print media advancement control in the system 100. FIG. 2A illustrates the VCM 135 in the open position, where no vacuum force is provided to a print media. A vacuum chamber 202 is created by a platen 204 forming the top of the vacuum chamber 202 and being supported by a U-shaped vacuum guide 206. The vacuum guide 206 is supported by a beam 208. The VCM 135 includes a sealing plate control mechanism 220, which includes a sealing plate 222 connected to a linear solenoid switch 224 via a piston 226. The piston 226 is supported by a linear ride 228, which provides accurate linear travel for the piston 226. Left and right wings 231 and 232 may optionally be connected to the sealing plate 222 if an additional pull-out force is needed, but are not required for this embodiment. A vacuum fan 240 is connected to the vacuum chamber 202 for generating a vacuum in the vacuum chamber 202.

In an exemplary embodiment, the solenoid switch 224 receives print media advance signals from the controller 105, which causes the solenoid switch 224 to move the sealing plate 222 in a linear motion away from the vacuum chamber 202. For example, when the solenoid switch 224 receives a print media advance signal, the piston 226 retracts. This causes the sealing plate 222 to travel linearly away from the vacuum chamber 202, and the vacuum chamber 202 becomes pressurized because it is substantially open to the atmosphere (i.e., air flows into the vacuum chamber). When the vacuum chamber 202 is open, such as shown in FIG. 2A, the vacuum force applied against a print media (not shown) supported by the platen 204 is removed. Instead, the vacuum force is generated at the opening of the vacuum chamber 202, as illustrated by the vacuum flow 240. Then, the print media can advance with minimal friction against the platen 204.

FIG. 2B illustrates the sealing plate control mechanism 220 in a closed position, where a vacuum force is applied to a print media supported by the platen 204. For example, when the solenoid switch 224 does not receive a print media advance signal, the solenoid switch 224 applies pressure to the piston 226, such that the sealing plate 222 is sealed against a side surface of the vacuum guide 206 and a side surface of the platen 204. For example, the sealing plate 222 moves linearly towards the vacuum chamber 202 on the linear ride 228 to close the vacuum chamber 202. When the sealing plate 222 is sealed against the side surfaces of the vacuum guide 206 and the platen 204, a vacuum force is generated on a print media through orifices 210 in the platen 204, as illustrated by the vacuum flow 240. The vacuum force keeps the print media stationary on the platen 204, and can be applied, for example, in a print zone during printing or in other areas where it is necessary to keep the print media stationary.

In one embodiment, the solenoid switch 224 employs a conventional linear slide technology that functions to slide the piston 226 along the linear ride 228. For example, the solenoid switch 224 maintains the sealing plate 222 in the position shown in FIG. 2B, such that the vacuum chamber is closed. When the solenoid switch receives a print media advance signal from the controller 105, the linear slide technology retracts the piston 226. This results in the sealing plate 222 being removed from the vacuum chamber 202, and the vacuum chamber is open. The solenoid switch may pulse the piston 226 to allow the vacuum chamber 202 to be momentarily open. This allows enough time for the print media to advance along the top surface of the platen 204 with minimal friction.

Figure 3:
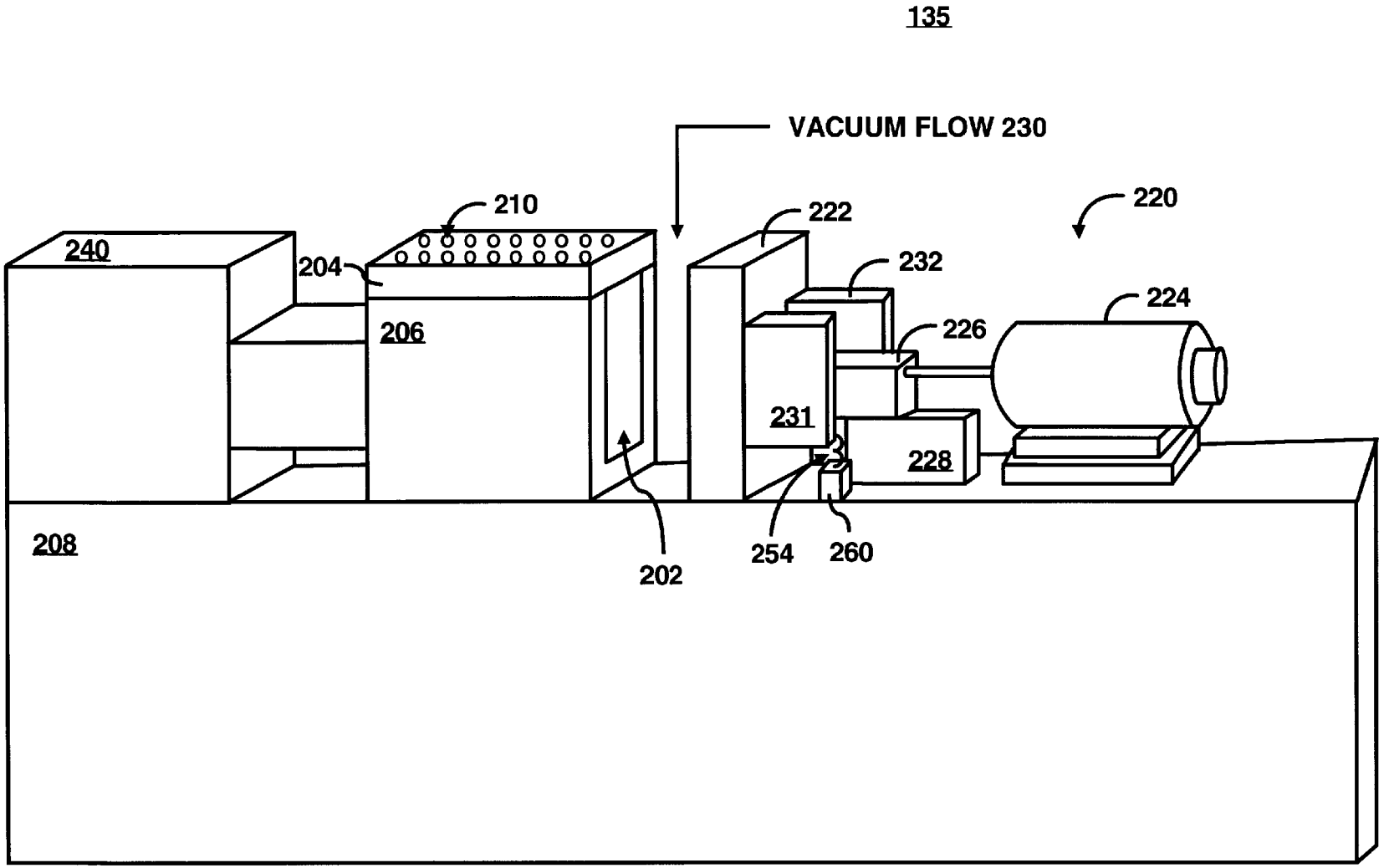
FIG. 3 illustrates an embodiment of a vacuum control mechanism.

In another embodiment, shown in FIG. 3, the sealing plate 222 includes wings 231 and 232, which are spaced, parallel supports. The wings 231 and 232 support springs 254 and 256 respectively. The springs 254 and 256 are connected to pins 260 and 262 extending upwards from the beam 208. The spring 256 and the pin 262 are hidden from view and are connected to the wing 232 and positioned similarly to the spring 254 and the pin 260 connected to the wing 231. When the solenoid switch 224 is not applying force on the sealing plate 204 to seal the vacuum chamber 202, the springs function to move the piston 226 and the sealing plate 222 away from the vacuum chamber. It will be apparent to one of ordinary skill in the art that a single spring and pin may be used if the spring maintains enough force to linearly slide the piston away from the vacuum chamber 202.

In this embodiment, the solenoid switch 224 continually forces the sealing plate 222 against the vacuum chamber 202, such that the vacuum chamber 202 generates a vacuum force, such as illustrated in FIG. 2B. When the solenoid switch 224 receives a print media advance signal from the controller 105, the solenoid switch 224 momentarily removes the force from the piston 226. The springs 254 and 256 cause the piston 226 to retract, and the vacuum chamber 202 opens momentarily, as illustrated in FIG. 2A. The print media may then advance along the top surface of the platen 204 with minimal friction.

Figure 4:
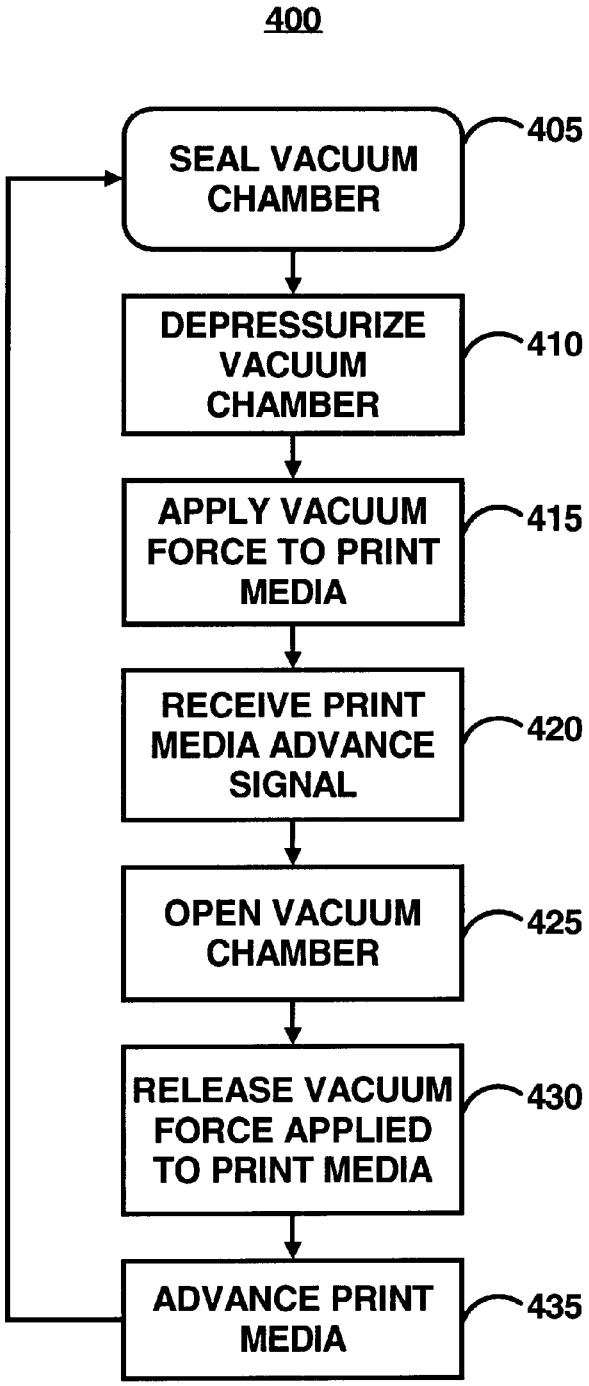
FIG. 4 illustrates an exemplary method employing principles of the invention.

FIG. 4 illustrates an exemplary method 400 employing principles of the present invention. In step 405, the vacuum chamber 202 is substantially sealed. For example, the solenoid switch 224 applies force to the sealing plate 222 via the piston 226, such that the sealing plate 222 seals the vacuum chamber 202.

At step 410, the vacuum chamber 202 is depressurized. For example, the vacuum fan 240 is connected to the vacuum chamber 202. The vacuum fan 240 may be continually running. When the vacuum chamber 202 is sealed, the vacuum chamber automatically depressurizes, creating a vacuum within the vacuum chamber 202.

At step 415, when the vacuum chamber 202 is depressurized, a vacuum force (e.g., the vacuum flow 240, shown in FIG. 2B) is generated on print media through the platen 204. For example, a sheet of print media rests on the top surface of the platen 204. A vacuum force is generated through the orifices 210 in the platen 204 to hold the sheet of print media in a substantially stationary manner.

At step 420, the VCM 135 receives a print media advance signal from the controller 105. For example, the solenoid switch 224 receives the print media advance signal from the controller 105.

At step 425, the vacuum chamber 202 is substantially open to the atmosphere. For example, the solenoid switch 224 retracts the piston 226, which causes the sealing plate 222 to travel linearly away from the vacuum chamber 202. Then, the vacuum chamber 202 is substantially open to the atmosphere.

In another embodiment (shown in FIG. 3), the solenoid switch 224 continually applies a force to the piston 226, which causes the sealing plate 222 to close and seal the vacuum chamber 202. When the solenoid switch 224 receives the print media advance signal, the solenoid switch 224 releases the force applied to the piston 226. Then, the springs 254 and 256 cause the sealing plate 222 to travel linearly away from the vacuum chamber 202. Then, the vacuum chamber 202 is substantially open to the atmosphere.

At step 430, the vacuum force is released from the print media on the top surface of the platen 204. For example, when the vacuum chamber 202 is opened, such as shown in FIG. 2A, the vacuum chamber 202 substantially instantly pressurizes (e.g., in less than 0.1 seconds), and the vacuum flow shifts from the platen (e.g., the vacuum flow 240) to outside the vacuum chamber (e.g., the vacuum flow 230).

At step 435, the print media advances from the top surface of the platen 204. Because, the vacuum force is released from the print media on the top surface of the platen 204, the print media may easily advance with minimal friction against the platen 204. Furthermore, the print media may advance almost immediately after the VCM 135 receives the print media advance signal, because of the minimal period of time required to pressurize the vacuum chamber 202.

After step 435, the method 400 may return to step 405. For example, the VCM 135 may pulse, such that the vacuum chamber 202 momentarily opens and closes upon receipt of a print media advance signal from the controller 105.

While this invention has been described in conjunction with the specific embodiments thereof, it is evident that many alternatives, modifications and variations will be apparent to those skilled in the art. For example, conventional switches, other than a solenoid switch may be used in the VCM 135. Also, it will be apparent to one of ordinary skill in the art that control mechanism 220 may be comprised of other mechanisms that are functional to open and close a vacuum chamber. Also, the controller 105 may transmit more than one control signal to the VCM 135. For example, the controller 105 may transmit a print media advance signal to the VCM 135, which causes the vacuum chamber 202 to be opened. Then, the VCM 135 may continue to keep the vacuum chamber 202 open until the VCM 135 receives a print media hold signal from the controller 105. Then, the VCM 135 seals the vacuum chamber 202. These and other changes that may be made without departing from the spirit and scope of the invention.

What is claimed is:

1. A method of controlling print media advancement in a printing device, the method comprising steps of:

substantially sealing a vacuum chamber by applying force to a sealing plate for substantially sealing the vacuum chamber;

depressurizing the vacuum chamber to generate a vacuum force for holding a print media;

opening the vacuum chamber to substantially pressurize the vacuum chamber; and advancing the print media.

2. The method of claim 1, wherein the step of opening farther comprises steps of:

receiving a print media advance signal from a controller in the printing device; and performing the step of opening in response to receiving the print media advance signal.

3. The method of claim 2, wherein the step of opening further comprises steps of:

decreasing the vacuum force applied to the print media.

4. The method of claim 1, wherein the step of substantially sealing further comprises a step of applying the force with a piston connected to a solenoid switch, wherein the piston forces the sealing plate against the vacuum chamber.

5. The method of claim 1, wherein the step of depressurizing the vacuum chamber further comprises depressurizing the vacuum chamber to generate a vacuum force to hold a print media for printing on the print media.

6. A method of controlling print media advancement in a printing device, the method comprising the steps of:

substantially sealing a vacuum chamber;

depressurizing the vacuum chamber to generate a vacuum force for holding a print media;

opening the vacuum chamber to substantially pressurize the vacuum chamber, wherein the step of opening further comprises a step of retracting a sealing plate from the vacuum chamber to substantially open the vacuum chamber; and advancing the print media.

7. The method of claim 6, wherein the step of retracting a sealing plate further comprises a step of retracting a piston connected to a solenoid switch in response to a force applied by the solenoid switch, wherein the sealing plate is connected to the piston.

8. The method of claim 6, wherein the step of retracting a sealing plate further comprises a step of retracting a piston connected to a solenoid switch in response to a force applied by at least one spring, wherein the sealing plate is connected to the piston.

9. A printing device comprising:

a vacuum control mechanism for controlling a vacuum force applied to a print media, the vacuum control mechanism having a platen with orifices therein through which the vacuum force is applied to the media, the vacuum control mechanism being configured to move a sealing plate to substantially open and close a vacuum chamber to control the vacuum force applied to the print media; the sealing plate forming a side of the vacuum chamber adjacent to the platen.

10. The printing device of claim 9, wherein the vacuum chamber includes a U-shaped vacuum guide, the platen covering the U-shaped vacuum guide and forming the top of the vacuum chamber.

11. The printing device of claim 9, wherein the vacuum control mechanism comprises a sealing plate control mechanism including a solenoid switch having a piston connected to the sealing plate forming a side of the vacuum chamber, the sealing plate being removable to substantially open and close the vacuum chamber.

12. The printing device of claim 9, wherein the vacuum control mechanism is included in a print media advancement subsystem in the printing device.

13. A print media advancement subsystem in a printing device, the print media advancement subsystem comprising:

a vacuum chamber including a U-shaped vacuum guide, a platen covering the U-shaped vacuum guide and forming the top of the vacuum chamber, and a sealing plate forming a side of the vacuum chamber, wherein the sealing plate is removable to substantially open and substantially seal the vacuum chamber, a vacuum force being applied through the platen to a print media supported by a top surface of the platen when the vacuum chamber is substantially sealed, and the vacuum force being substantially removed from the print media when the vacuum chamber is substantially open; and a control mechanism connected to the sealing plate and configured to remove the sealing plate from the vacuum chamber in response to receiving a print media advance signal from a controller in the printing device.

14. A printing device comprising:

a vacuum control mechanism for controlling a vacuum force applied to a print media, the vacuum control mechanism being configured to move a sealing plate to substantially open and close a vacuum chamber to control the vacuum force applied to the print media; the sealing plate forming a side of the vacuum chamber; and wherein the vacuum chamber includes a U-shaped vacuum guide, and a platen covering the U-shaped vacuum guide and forming the top of the vacuum chamber.

15. The printing device of claim 14, wherein the vacuum force is configured to be applied to the print media through the platen, the print media being configured to be supported on a top surface of the platen.

16. The printing device of claim 15, wherein the vacuum force is applied to the print media when the vacuum chamber is closed, and the vacuum force is substantially removed from the print media when the vacuum chamber is opened.

17. The printing device of claim 16, wherein the printing device further comprises a controller, and the sealing plate is removed from the vacuum chamber to open the vacuum chamber in response to receiving a print media advance signal from the controller.

18. A printing device comprising:

a vacuum control mechanism for controlling a vacuum force applied to a print media, the vacuum control mechanism being configured to move a sealing plate to substantially open and close a vacuum chamber to control the vacuum force applied to the print media; the sealing plate forming a side of the vacuum chamber; and wherein the vacuum control mechanism comprises a sealing plate control mechanism including a solenoid switch having a piston connected to the sealing plate forming a side of the vacuum chamber, the sealing plate being removable to substantially open and close the vacuum chamber.

19. The printing device of claim 18, wherein the solenoid switch is configured to extend the piston to place the sealing plate against the vacuum chamber, the vacuum chamber being substantially sealed and operable to become depressurized for generating the vacuum force when the sealing plate is placed against the vacuum chamber.

20. The printing device of claim 19, wherein the solenoid switch is configured to retract the piston to remove the sealing plate from the vacuum chamber, the vacuum chamber being substantially open and operable to become pressurized for substantially removing the vacuum force when the piston is retracted.

21. The printing device of claim 19, wherein the vacuum control mechanism includes at least one spring connected to the sealing plate and operable to generate a force for retracting the piston, the vacuum chamber being substantially open and operable to become pressurized for substantially removing the vacuum force when the piston is retracted.

* * * * *

UNITED STATES PATENT AND TRADEMARK OFFICE

CERTIFICATE OF CORRECTION

PATENT NO. : 6,640,708 B2
DATED : November 4, 2003
INVENTOR(S) : Perez et al.

It is certified that error appears in the above-identified patent and that said Letters Patent is hereby corrected as shown below:

Column 5,
Line 57, replace “0.1 seconds” with -- .1 seconds --.

Column 6,
Line 36, replace “farther” with -- further --.

Signed and Sealed this

Thirteenth Day of April, 2004

JON W. DUDAS
*Acting Director of the United States Patent and Trademark Office*